US005714311A

United States Patent [19]

Cowdery-Corvan et al.

[11] Patent Number: 5,714,311

[45] Date of Patent: Feb. 3, 1998

[54] THERMALLY PROCESSABLE IMAGING ELEMENT COMPRISING ARYLIODONIUM COMPOUNDS

[75] Inventors: Peter J. Cowdery-Corvan, Webster; Roger L. Klaus, Rochester; Franklin D. Saeva, Webster, all of N.Y.

[73] Assignee: Eastman Kodak Company, Rochester, N.Y.

[21] Appl. No.: 780,510

[22] Filed: Jan. 8, 1997

[51] Int. Cl.[6] ..... G03C 1/498

[52] U.S. Cl. ..... 430/607; 430/617; 430/619

[58] Field of Search ..... 430/617, 619, 430/607

[56] References Cited

U.S. PATENT DOCUMENTS

| | | | |
|---|---|---|---|
| 2,105,274 | 1/1938 | Steigmann | 430/398 |
| 3,554,758 | 1/1971 | Willems et al. | 430/602 |
| 3,817,753 | 6/1974 | Willems et al. | 430/265 |
| 3,928,043 | 12/1975 | Ciurca, Jr. | 430/212 |

FOREIGN PATENT DOCUMENTS

| | | | |
|---|---|---|---|
| 1552027 | 9/1979 | United Kingdom | 430/357 |

*Primary Examiner*—Thorl Chea
*Attorney, Agent, or Firm*—Sarah Meeks Roberts

[57] ABSTRACT

This invention provides a thermally processable imaging element comprising a support and a thermographic or photothermographic imaging layer, said imaging layer comprising an aryliodonium compound represented by the formula:

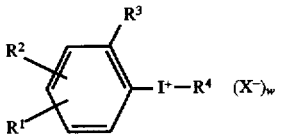

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

In one embodiment the thermally processable imaging element comprises:

(a) photographic silver halide, and (b) an image-forming combination comprising (i) an organic silver salt oxidizing agent, with (ii) a reducing agent for the organic silver salt oxidizing agent.

16 Claims, No Drawings

THERMALLY PROCESSABLE IMAGING ELEMENT COMPRISING ARYLIODONIUM COMPOUNDS

FIELD OF THE INVENTION

This invention relates in general to imaging elements and in particular to thermally processable imaging elements. More specifically, this invention relates to imaging elements which comprise a thermographic layer or photothermographic layer and which contain aryliodonium compounds as antifoggants.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure*, June 1978, Item No. 17029 and U.S. Pat. Nos. 3,080,254, 3,457,075 and 3,933,508.

One common photothermographic element comprises an oxidation-reduction image forming composition containing an organic silver salt oxidizing agent, a photocatalyst such as silver halide, and a reducing agent. The element is stable at ambient temperature, however, after exposure to light, the organic silver salt oxidizing agent and the reducing agent, when heated, undergo an oxidation-reduction reaction due to the catalytic action of the photocatalyst and form silver. The silver formed darkens the exposed areas of the photosensitive layer and creates an image.

A problem which frequently occurs with these types of elements is unintentional darkening of the unexposed areas of the photosensitive layer. This may be caused by reducing agent impurities in the coated element. This darkening is often referred to as fog. One compound which has been commonly used to suppress fog is mercuric ion. However it is known that mercury is detrimental to the environment. There is a continuing need for practical and environmentally benign stabilizers and antifoggants which do not otherwise adversely affect the performance of the thermographic element. The inventors herein have discovered that organic aryliodonium carboxylates are particularly useful as fog restrainers for such elements.

Diphenyliodonium salts have been described in U.S. Pat. Nos. 2,105,274 and 3,817,753 as silver halide development antifoggants and development modifiers Diaryliodonium salts of mercuric halides have been described in U.S. Pat. No. 3,554,758 as silver halide fog inhibitors. Organic iodyl compounds are described in U.S. Pat. No. 3,928,043 as oxidants for leuco dyes, particularly in color diffusion transfer elements. Organic multivalent iodine compounds are described in GB 1,552,027 as intensifying agents when added to a photographic material or processing solutions for color silver halide materials. However, there is no suggestion in the art that certain aryliodonium compounds may be utilized as fog restrainers as described hereafter.

SUMMARY OF THE INVENTION

This invention provides a thermally processable imaging element comprising a support and a thermographic or photothermographic imaging layer, said imaging layer comprising an aryliodonium compound represented by the formula:

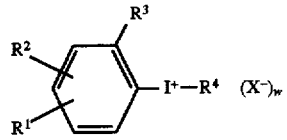

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

In one embodiment the thermally processable imaging element comprises:

(a) photographic silver halide, and (b) an image-forming combination comprising (i) an organic silver salt oxidizing agent, with (ii) a reducing agent for the organic silver salt oxidizing agent.

The thermally processable elements of this invention exhibit less fog without a large loss of photographic speed. The aryliodonium compounds used in this invention can be used to replace mercuric salts and are themselves environmentally benign.

DETAILED DESCRIPTION OF THE INVENTION

The aryliodonium carboxylate compounds utilized in this invention are represented by the following formula:

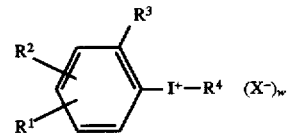

wherein $R^1$ and $R^2$ and $R^3$ can be any substituents which are suitable for use in a silver halide photographic element and which do not interfere with the fog restraining activity of the aryliodonium compound. $R^1$, $R^2$ and $R^3$ may be independently H, or a substituted or unsubstituted aliphatic, aromatic, or heterocyclic group or any two of $R^1$, $R^2$ and $R^3$ may together represent the atoms necessary to form a 5 or 6-membered ring or a multiple ring system. $R^1$, $R^2$ and $R^3$ may also be alkoxy groups (for example, methoxy, ethoxy, octyloxy), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acyloxy groups (for example, acetoxy, benzoxy), carboxyl groups, cyano groups, nitro groups, sulfo groups, alkylsulfoxide groups and trifluouroalkyl groups. In one preferred embodiment $R^1$, $R^2$ and $R^3$ are independently H, or aliphatic, aromatic or heterocyclic groups. In another preferred embodiment $R^1$ and $R^2$ are independently H, halogen atoms, or aliphatic, aromatic or heterocyclic groups and R3 is a sulfo or carboxyl group.

When $R^1$, $R^2$ and $R^3$ are aliphatic groups, preferably, they are alkyl groups having from 1 to 22 carbon atoms, or alkenyl or alkynyl groups having from 2 to 22 carbon atoms. More preferably, they are alkyl groups having 1 to 10 carbon atoms, or alkenyl or alkynyl groups having 3 to 5 carbon atoms. Most preferably they are alkyl groups having 1 to 5 carbon atoms. These groups may or may not have substituents. Examples of alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms and include, among others, phenyl and naphthyl groups. More preferably, the aromatic groups have 6 to 10 carbon atoms and most preferably the aromatic groups are phenyl. These groups may be substituted or unsubstituted. The heterocyclic groups are 3 to 15-membered rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

Any one of $R^1$, $R^2$ and $R^3$ may together form a ring or multiple ring system. These ring systems may be unsubstituted or substituted. The ring and multiple ring systems formed by $R^1$, $R^2$ and $R^3$ may be alicyclic or they may be the aromatic and heterocyclic groups described above.

$R^4$ is a carboxylate salt such as acetate, benzoate or trifluoroacetate, or other longer chain acids or $R^4$ is $O^-$.

Formate is not generally utilized for $R^4$ because formate itself can cause fogging problems. W is 0 or 1. When $R^3$ is a sulfo or carboxyl group w is 0 and $R^4$ is $O^-$.

$X^-$ is any anionic counter ion which is suitable for use in a photographic element and which does not interfere with the fog restraining effect of the compound. Preferably the counter ions are water soluble. Suitable examples of $X^-$ include $CH_3CO_2$, Cl, $CF_3SO_3$, $PF_6$, Br, $BF_4$, $AsF_6$, $CH_3SO_3$, $CF_3CO_2$, $CH_3C_6H_4SO_3$, $HSO_4$, $SbF_6$, and $CCl_3CO_2$. Particularly useful are $CH_3CO_2$, $CH_3SO_3$ and $PF_6$.

Nonlimiting examples of substituent groups for $R^1$, $R^2$ and $R^3$ and $R^4$ include alkyl groups (for example, methyl, ethyl, hexyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred substituents are lower alkyl groups, i.e., those having 1 to 4 carbon atoms (for example, methyl) and halogen groups (for example, chloro).

Specific examples of the aryliodonium compounds include, but are not limited to

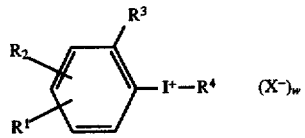

| Compound | $R^1$ | $R^2$ | $R^3$ | $R^4$ | W | X |
|---|---|---|---|---|---|---|
| 1 | H | H | H | $OCOCH_3$ | 1 | $OCOCH_3$ |
| 2 | H | H | H | $OCOCF_3$ | 1 | $OCOCF_3$ |
| 3 | H | $CH_3$ | H | $OCOCH_3$ | 1 | $OCOCH_3$ |
| 4 | H | $CH_3$ | $CO_2H$ | $O^-$ | 0 | — |
| 5 | H | H | $CO_2H$ | $O^-$ | 0 | — |
| 6 | H | CN | $CO_2H$ | $O^-$ | 0 | — |
| 7 | $OCH_3$ | $CH_3$ | H | $OCOCH_3$ | 1 | $OCOCH_3$ |
| 8 | $CH_3$ | $CH_3$ | $CH_3$ | $OCOCH_3$ | 1 | $OCOCH_3$ |
| 9 | $CH_3$ | $CH_3$ | H | $OCOCH_3$ | 1 | $OCOCH_3$ |
| 12 | $CH_3$ | $CH_3$ | $CO_2H$ | $O^-$ | 0 | — |
| 13 | H | H | $SO_3H$ | $O^-$ | 0 | — |
| 14 | H | CN | $CO_2H$ | $O^-$ | 0 | — |
| 15 | $OCH_3$ | Cl | H | $OCOCH_3$ | 1 | $OCOCH_3$ |
| 16 | $CO_2H$ | H | H | $OCOCH_3$ | 1 | $OCOCH_3$ |
| 17 | $OCH_3$ | Cl | $CH_3$ | $OCOCH_3$ | 1 | $OCOCH_3$ |
| 18 | H | H | H | $OCOCH_2CH_3$ | 1 | $OCOCH_2CH_3$ |
| 19 | H | $CH_2OH$ | H | $OCOCH_3$ | 1 | $OCOCH_3$ |
| 20 | Cl | $CH_2OH$ | $CO_2H$ | $O^-$ | 0 | — |
| 21 | Cl | $CH_3$ | $SO_3H$ | $O^-$ | 0 | — |
| 22 | $CH_3$ | CN | $CO_2H$ | $O^-$ | 0 | — |
| 23 | $CF_3$ | Cl | H | $OCOCH_3$ | 1 | $OCOCH_3$ |
| 24 | $CO_2H$ | H | H | $OCOCH_3$ | 1 | $OCOCH_3$ |
| 25 | $OCCH_3$ | H | $C_6H_5$ | $OCOCH_3$ | 1 | $OCOCH_3$ |
| 26 | $C_6H_5$ | H | H | $OCOCH_3$ | 1 | $OCOCH_2CH_3$ |
| 27 | $C_6H_4CO_2H$ | H | H | $OCOCH_3$ | 1 | $OCOCH_3$ |
| 28 | H | $CH_2OH$ | $CO_2H$ | $O^-$ | 0 | — |

-continued

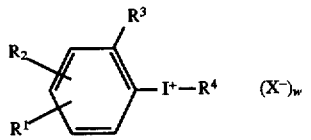

| Compound | $R^1$ | $R^2$ | $R^3$ | $R^4$ | W | X |
|---|---|---|---|---|---|---|
| 29 | $SO_2CH_3$ | H | H | $OCOCH_3$ | 1 | $OCOCH_3$ |
| 30 | Cl | CN | $CO_2H$ | $O^-$ | 0 | — |
| 31 | $CF_3$ | $OCH_3$ | H | $OCOCH_3$ | 1 | $OCOCH_3$ |
| 32 | $CO_2H$ | $CO_2H$ | H | $OCOCH_3$ | 1 | $OCOCH_3$ |

Compounds 1, 2, 5, 12, 16, 19, 24, 25, and 29 are examples of particularly suitable compounds for use in this invention.

The aryliodonium compounds are readily synthesized by reaction of the iodosoaryl compound and the corresponding anhydride as discussed in *Org. Syn.*, 1961 and in "Advanced Organic Chemistry," by Fieser & Fieser, Reinhold, N.Y., 1961 and as shown below:

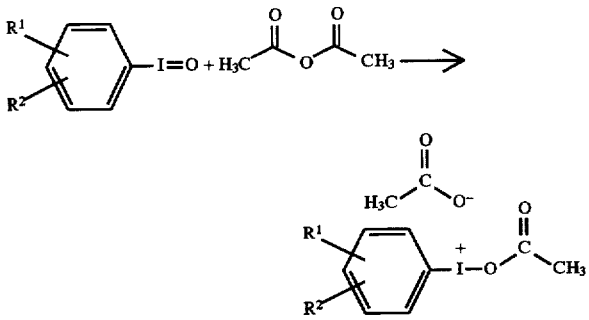

Many of these compounds are commercially available.

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention. Nonlimiting examples of suitable substituents are as described above for the substituent groups for $R^1$, $R^2$, $R^3$ and $R^4$.

Useful levels of the aryliodonium compounds range from about 0.001 to 0.5000 mole and preferably from 0.001 to 0.05 mole based on one mole of silver salt oxidizing agent. The aryliodonium compounds may be added in any fashion which does not interfere with antifogging action of the compounds. The aryliodonium antifoggant is most effective when added to the silver salt oxidizing agent or it may conveniently added as a doctor solution at any point in the melt preparation prior to the addition of developer.

The thermally processable imaging element of this invention can be of the type in which an image is formed by imagewise heating of the element or of the type in which an image is formed by imagewise exposure to light followed by uniform heating of the element. The latter type of element is commonly referred to as a photothermographic element.

Typical photothermographic imaging elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, with (ii) a reducing agent for the organic silver salt oxidizing agent and (c) an optional toning agent. References describing such imaging elements include, for example, U.S. Pat. Nos. 3,457,075; 4,459,350; 4,264,725 and 4,741,992 and *Research Disclosure*, June 1978, Item No. 17029.

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure*, December 1978, Item No. 17029 and *Research Disclosure*, June 1978, Item No. 17643. Tabular Grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above *Research Disclosure* publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of Useful organic silver salt oxidizing agents are silver behenate, silver stearate, silver oleate, silver laurate, silver hydroxystearate, silver caprate, silver myristate, and silver palmitate, with silver behenate being particularly useful. Combinations of organic silver salt oxidizing agents are also useful. An example of a useful organic silver salt oxidizing agent that is not an organic silver salt of a fatty acid is silver benzotriazole.

The optimum concentration of organic silver salt oxidizing agent in the photothermographic element will vary depending upon the desired image, particular organic silver salt oxidizing agent, particular reducing agent and particular photothermographic element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazoliaone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure*, June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,321. Examples of useful sulfonamidophenol reducing agents are 2,6-dichloro-4-benzenesulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt and the particular oxidizing agent.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure*, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly (vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly (vinylpyrrolidone), ethyl cellulose, polystyrene, poly (vinyichloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The thermally processable element can comprise a variety of supports. Examples of useful supports are poly (vinylacetal) film, polystyrene film, poly (ethyleneterephthalate) film, poly(ethylene naphthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure*, June 1978, Item No. 17029 and *Research Disclosure*, December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)-benzothiazole; and 6-substituted-2,4-bis (tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C., until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

In the case of a thermographic element, the thermal energy source and means for imaging can be any imagewise thermal exposure source and means that are known in the thermographic imaging art. The thermographic imaging means can be, for example, an infrared heating means, laser, resistive head heater, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

The following non-limiting examples will further illustrate this invention.

EXAMPLES

Example 1

A control photothermographic element was prepared having the following composition:

| Component | Grams |
|---|---|
| Silver behenate dispersion (contains 19.4% by weight silver behenate in 5.0% by weight methyl isobutyl ketone (MIBK) solution of polyvinylbutyral (Butvar B-76 which is a trademark of Monsanto Co., USA) | 44.39 |
| Sodium Iodide | 0.052 |
| Silver bromide (silver bromide emulsion contains 42.0 grams Ag/liter in 11.4% by weight MIBK solution of Butvar B-76) | 8.06 |
| Succinimide development accelerator (8.8% by weight in 12.3% by weight acetone solution of Butvar B-76) | 4.84 |
| SF-96 (5% by weight of SF-96 in MIBK. SF-96 is a polysiloxane fluid available from and a trademark of General Electric Co., U.S.A. | 0.143 |
| 2-Bromo-2-(4-methylphenylsulfonyl) acetamide (4.0% by weight in acetone) | 2.79 |
| 2,4-Bis(trichloromethyl)-6-(1-naphthyl)-s-triazine | 0.027 |
| Palmitic acid (10% by weight in acetone) | 1.74 |
| Sensitizing dye, (SS-1) (0.10% by weight in 13.5% by weight acetone solution of Butvar B-76) | 9.84 |
| 4-Benzenesulfonamidophenol (8.4% by weight in 8.7% by weight MIBK solution of Butvar B-76) | 28.16 |
| | 100.0 |

SS-1

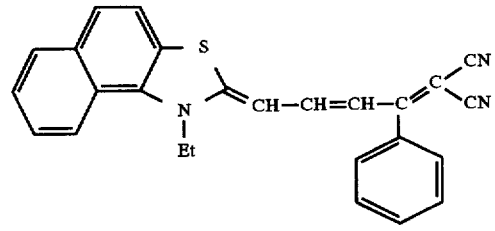

The resulting photothermographic silver halide composition was coated at a wet laydown of 5.64 g/ft$^2$ on a poly(ethyleneterephthylate) film support. The coating was dried at 77° C. for 2 minutes in an air chamber and was then overcoated with the following overcoat composition:

| Component | Grams |
|---|---|
| Polyvinylalcohol (A 6.0% by weight solution in water of Elvanol 52/22 which is a trademark of E. I. DuPont de Nemours Co., Inc. | 31.8 |
| Distilled water | 48.6 |
| Hydrolyzed tetraethyl ortho silicate sol-gel (16.5% by weight silica in water/methanol). see US 4,741,992. | 18.5 |
| Surfactant (10 G which is para-isononylphenoxypolyglycidol and is a trademark of and available from Olin Corp., USA) | 0.17 |
| Matte | 0.82 |
| Blue dye (Victoria Pure Blue BO, Aldrich Chemical Co., Inc. | 0.04 |
| | 100.0 |

The resulting overcoat composition was coated over the dried photothermographic silver halide composition to a wet laydown of 3.51 g/ft$^2$. The coating was permitted to dry at 77° C. for 2 minutes in an air chamber. In this example, only the composition of the photothermographic layer varies. The composition of the overcoat is constant and is as described above.

Five identical sample films were prepared as above with the only differences being the presence/absence of the intentional foggant $SnCl_2$ and the type/level of the antifoggant as specified in Table I. The antifoggant iodobenzene diacetate (IDA) was obtained from Aldrich Chemical Co., Inc. The IDA was added as a 5% by weight solution in methanol to the emulsion layer melt before the addition of developer. The $SnCl_2$ foggant solution was prepared by adding 0.10 g $SnCl_2$ to 40 g acetone. The foggant solution was added to the silver behenate dispersion.

TABLE I

| Coating | Amount $SnCl_2$ Foggant | Antifoggant Type/Level |
|---|---|---|
| 1 | None | None (Control) |
| 2 | 0.12 mg/ft$^2$ | None |
| 3 | 0.12 mg/ft$^2$ | $HgBr_2$, 0.22 mg/ft$^2$ |
| 4 | 0.12 mg/ft$^2$ | IDA 5.3 mg/ft$^2$ |
| 5 | 0.12 mg ft$^2$ | IDA 10.6 mg/ft$^2$ |

These five coatings were exposed using an EG&G sensitometer equipped with a xenon flash lamp having a $10^{-3}$ sec exposure time, through a step wedge. Immediately after the exposure step, the films were heat processed at 119° C. for five seconds. The negative images on each film were evaluated on a densitometer using Status A, blue filtration. The sensitometric data for each film is recorded in Table II.

TABLE II

| Coating | Dmin | Dmax | Speed |
|---|---|---|---|
| 1 | 0.13 | 2.25 | 249 |
| 2 | 0.27 | 2.34 | 250 |
| 3 | 0.15 | 2.25 | 252 |
| 4 | 0.17 | 1.69 | 212 |
| 5 | 0.13 | 1.36 | 180 |

The sensitometric data in Table II demonstrates that the use of the iodobenzene diacetate antifoggant is effective in reducing the level of Dmin in an emulsion layer that had been intentionally fogged. When the same films were similarly exposed as in Table II but heat processed at 125° C. rather than 119° C., the following sensitometric data were obtained, Table III.

TABLE III

| Coating ID | Dmin | Dmax | Speed |
|---|---|---|---|
| 1 | 0.19 | 2.70 | 268 |
| 2 | 0.34 | 2.74 | 269 |
| 3 | 0.21 | 2.55 | 271 |
| 4 | 0.20 | 2.25 | 235 |
| 5 | 0.14 | 1.77 | 191 |

The sensitometric data in Table III demonstrates that the use of the iodobenzenediacetate antifoggant is effective in reducing the level of Dmin in films that have been push processed (processed at a higher temperature) than the check film which contained the intentional foggant and no antifoggant (coating #2).

The coatings containing the iodobenzene diacetate antifoggant exhibited good keeping sensitometry over extended time. Coatings 1–4 of the above series were stored at 15% relative humidity at room temperature for six months, then removed from this environment and exposed and processed at 119° C. as above. The sensitometric results are shown in Table IV.

TABLE IV

| Coating | Dmin | Dmax | Speed |
|---|---|---|---|
| 1 | 0.18 | 3.11 | 255 |
| 2 | 0.23 | 3.09 | 251 |
| 3 | 0.18 | 2.69 | 251 |
| 4 | 0.18 | 3.09 | 244 |

Example 2

This example demonstrates that the iodobenzene diacetate antifoggant is capable of substantially reducing the level of fog (Dmin) in a photothermographic layer that contains a silver behenate dispersion having a high level of inherent fog, without the use of an intentional foggant. A photothermographic layer was prepared that was similar to that in Example 1 except that a different silver behenate solution was used. Also, a different cyanine sensitizing dye was used.

TABLE V

| Coating | Use of AgBe with High Inherent Fog | IDA Level | Dmin | Dmax | Speed |
|---|---|---|---|---|---|
| 6 | Yes | None (Control) | 0.39 | 2.78 | 309 |
| 7 | Yes | 2.65 mg/ft$^2$ | 0.19 | 2.62 | 317 |

The invention has been described in detail, with particular reference to certain preferred embodiments thereof, but it should be understood that variations and modifications can be effected within the spirit and scope of the invention.

What is claimed is:

1. A thermally processable imaging element comprising a support and a thermographic or photothermographic imaging layer, said imaging layer comprising an aryliodonium compound represented by the formula:

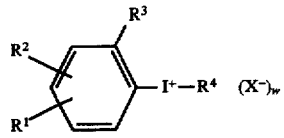

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

2. The photographic element of claim 1 wherein $R^1$, $R^2$ and $R^3$ are independently H, halogen atoms, or aliphatic, aromatic or heterocyclic groups.

3. The photographic element of claim 2 wherein $R^1$, $R^2$ and $R^3$ are independently H, an alkyl group having 1 to 10 carbon atoms or an aryl group having 6 to 10 carbon atoms.

4. The photographic element of claim 1 wherein $R^1$ and $R^2$ are independently H, halogen atoms, or aliphatic, aromatic or heterocyclic groups and $R^3$ is a sulfo or carboryl group.

5. The photographic element of claim 4 wherein $R^1$ and $R^2$ are independently H, an alkyl group having 1 to 10 carbon atoms or an aryl group having 6 to 10 carbon atoms.

6. The photographic element of claim 1 wherein $R^4$ is acetate, benzoate or trifluoroacetate.

7. A thermally processable imaging element, said element comprising:

(a) photographic silver halide, (b) an image-forming combination comprising (i) an organic silver salt oxidizing agent, with (ii) a reducing agent for the organic silver salt oxidizing agent, and (c) an aryliodonium compound represented by the formula:

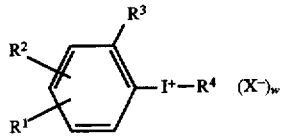

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

8. The photographic element of claim 7 wherein $R^1$, $R^2$ and $R^3$ are independently H, halogen atoms, or aliphatic, aromatic or heterocyclic groups.

9. The photographic element of claim 8 wherein $R^1$, $R^2$ and $R^3$ are independently H, an alkyl group having 1 to 10 carbon atoms or an aryl group having 6 to 10 carbon atoms.

10. The photographic element of claim 7 wherein $R^1$ and $R^2$ are independently H, halogen atoms, or aliphatic, aromatic or heterocyclic groups and $R^3$ is a sulfo or carboxyl group.

11. The photographic element of claim 10 wherein $R^1$ and $R^2$ are independently H, an alkyl group having 1 to 10 carbon atoms or an aryl group having 6 to 10 carbon atoms.

12. The photographic element of claim 7 wherein $R^4$ is acetate, benzoate or trifluoroacetate.

13. The photographic element of claim 7 wherein the concentration of the aryliodonium compound is from 0.001 to 0.5000 mol per mol of silver salt oxidizing agent.

14. The photographic element of claim 13 wherein the concentration of the aryliodonium compound is from 0.001 to 0.05 mol per mol of silver salt oxidizing agent.

15. The photographic element of claim 7 wherein the organic silver salt oxidizing compound is silver behenate.

16. The photographic element of claim 15 wherein the reducing agent is a phenolic reducing agent.

* * * * *